United States Patent [19]

Shapland et al.

[11] Patent Number: 4,545,512

[45] Date of Patent: Oct. 8, 1985

[54] FULL THROTTLE VALVE AND METHOD OF TUBE AND GATE CHANGE

[75] Inventors: Earl P. Shapland, Sarasota, Fla.; Patrick D. King, Rantoul, Ill.

[73] Assignee: USS Engineers & Consultants, Inc., Pittsburgh, Pa.

[21] Appl. No.: 525,867

[22] Filed: Oct. 27, 1983

Related U.S. Application Data

[60] Division of Ser. No. 225,895, Jan. 19, 1981, Pat. No. 4,415,103, which is a continuation-in-part of Ser. No. 73,588, Sep. 7, 1979, which is a continuation-in-part of Ser. No. 945,441, Sep. 25, 1978, abandoned, which is a continuation-in-part of Ser. No. 732,867, Oct. 15, 1976, abandoned.

[51] Int. Cl.[4] ..... B22D 41/08

[52] U.S. Cl. ..... 222/600; 222/603; 222/561

[58] Field of Search ..... 222/559, 561, 564, 566, 222/575, 591, 594, 597, 600, 603; 164/337, 437; 266/266

[56] References Cited

U.S. PATENT DOCUMENTS

| | | | |
|---|---|---|---|
| 1,944,611 | 1/1934 | Reinartz et al. | 222/591 |
| 3,866,806 | 2/1975 | Shapland, Jr. | 222/600 |

FOREIGN PATENT DOCUMENTS

| | | | |
|---|---|---|---|
| 3033977 | 7/1977 | Japan | 222/600 |
| 6606230 | 11/1966 | Netherlands | 222/600 |

*Primary Examiner*—H. Grant Skaggs
*Assistant Examiner*—Nils E. Pedersen
*Attorney, Agent, or Firm*—John F. Carney

[57] ABSTRACT

A sliding gate valve of the type in which refractory gates are sequentially disposed in operative position beneath the pour opening from a teeming vessel, such as a tundish, is effective to controllably throttle the metal flow stream from the vessel. Operator means for positioning the gates in order to control the degree of throttling of the flow stream are independent from the operator means for disposing the gates in their working position within the valve mechanism whereby the flow stream can be terminated without adjusting the throttling configuration of the valve. Means are provided, when the valve employs a pour tube attachment, for selectively changing gates and pour tubes in unison, or independently from one another. The valve mechanism and its replaceable refractory components are designed for the supply of fluids for cooling these members and for the injection of fluid reactants into the metal pouring process.

10 Claims, 13 Drawing Figures

FULL THROTTLE VALVE AND METHOD OF TUBE AND GATE CHANGE

RELATED APPLICATIONS

This is a divisional of application Ser. No. 225,895, now U.S. Pat. No. 4,415,103, filed Jan. 19, 1981, which is a continuation-in-part of U.S. patent application Ser. No. 073,588 (abandoned), filed Sept. 7, 1979 which is a continuation-in-part of U.S. patent application Ser. No. 945,441 (abandoned) filed Sept. 25, 1978 which is a continuation-in-part of U.S. patent application Ser. No. 732,867 (abandoned), filed Oct. 15, 1976.

BACKGROUND OF THE INVENTION

The present invention relates to the pouring of molten metal from teeming vessels. More particularly, it relates to valve apparatus for controlling the flow of molten metal from a teeming vessel into a receiver, such as, for example, the mold of a continuous caster.

In U.S. Pat. No. Re. 27,237, granted Nov. 23, 1971 to J. T. Shapland, there is described a valve apparatus for controlling the flow of metal from a bottom-pour vessel. The described valve incorporates refractory plates that are adapted to be moved in sequence into an operative position beneath the pour opening of the vessel. The plates utilized are either blank, imperforate members operative to prevent the flow of metal from the vessel or contain orifice openings sized to control the rate of metal teemed from the vessel. Flow regulation is achieved in such valve by selectively moving plates containing different diameter orifice openings in sequence into their operative position beneath the vessel pour opening.

Teeming valves of the described type are beneficial in that plate change is rapidly effected such that metal flow can be promptly terminated in the case of the development of a hazaradous condition. The valves are also beneficial in that changes in flow conditions for regulation purposes can be achieved in a minimum of time. Such valves, however, suffer from the disadvantages that the rate of flow through the valve can be regulated only by replacing the operative slide plate with one having an orifice opening of different diameter, thus precluding the ability to vary flow rates over an infinitely variable range. The need to change plates in order to alter metal flow conditions also renders the use of such prior art valves costly in that the number of plates utilized over a period of valve operation is increased and a large number of plates containing orifice openings of different diameters must be inventoried.

Infinitely variable metal teeming valves are not new as evidenced by U.S. Pat. Nos. 3,436,023, 3,454,201 and 3,866,806. However, none of these valves have the ability to maintain the flow throttling function of the valve completely independent of the emergency shutoff function. Accordingly, not only is rapid response to an unsafe condition requiring termination of flow unattainable with their use but also immediate return of flow to the regulated flow rate upon reinstatement of teeming is impossible.

It is to the solution of these and other problems attendant with the use of prior art metal teeming valves that the present invention is directed.

SUMMARY OF THE INVENTION

Accordingly, the present invention is directed to an improved sliding gate valve organization of the type in which successive slide plates are sequentially positionable with respect to the pour opening of a teeming vessel and in which the sliding plate can throttle the metal flow from the vessel over an infinitely variable range between the fully open condition of the valve to its fully closed condition.

The invention further improves upon prior art valves of the described type in that means are provided which enable throttling to occur over a partial range of metal flow or, alternatively, over the full range of metal flow without the need to change slide plates.

The described sliding gate valve organization is also characterized by the ability to rapidly insert a blank plate when it is desired to terminate metal flow for safety or other reasons and with the ability to change pour tubes either in conjunction with or independently from a slide plate change.

Yet another feature of the present invention is the provision of a sliding plate of particular configuration in teeming valves of the described type that enables its rapid insertion into its operative, sealed position between the valve top plate and the pour tube support plate without danger of damaging either of these refractory members.

Also contemplated by the present invention is a top plate of particular configuration that enables the effective distribution of inert gas injection into the vessel pour opening when the valve is in its closed condition, such plate being configured to permit its fabrication by conventional refractory-forming processes without the need for expensive machining.

Yet another feature of the hereindescribed sliding gate valve organization is the provision of means to effectively supply cooling air to the valve parts which are most sensitive to a high temperature atmosphere, including the seal springs and the refractory parts forming the pour opening of the vessel thereby reducing thermal deterioration of these parts.

A still further feature of the hereindescribed arrangement are means to promote reduced turbulence in the metal flow stream through the valve that may otherwise occur at reduced flow rates when the metal flow passage is restricted.

For a better understanding of the invention, its operating advantages and the specific objectives obtained by its use, reference should be made to the accompanying drawings and description which relate to a preferred embodiment thereof.

DESCRIPTION OF A PREFERRED EMBODIMENT OF THE INVENTION

Figure 1:
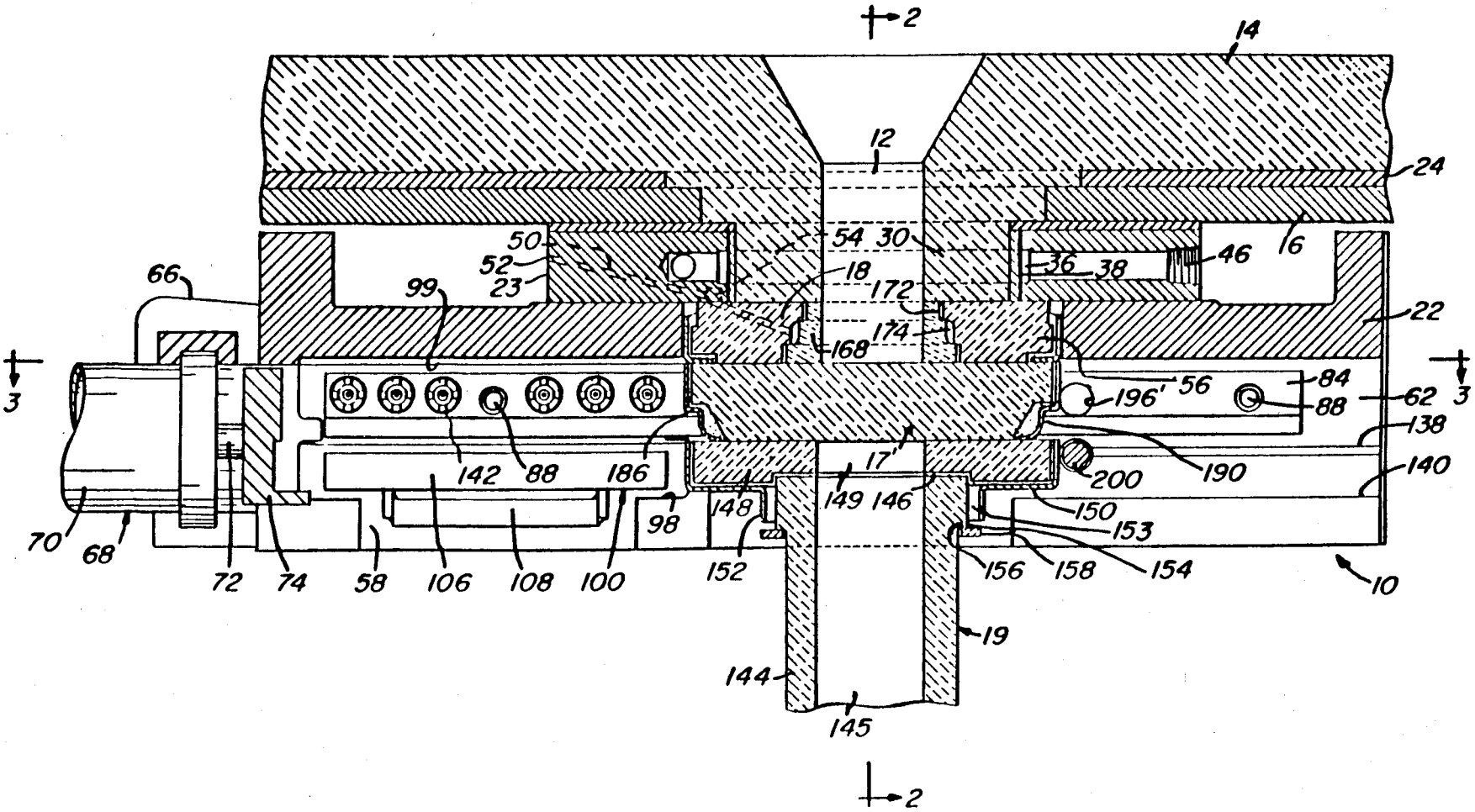
FIG. 1 is a vertical sectional view of the sliding gate valve of the present invention.
Figure 2:
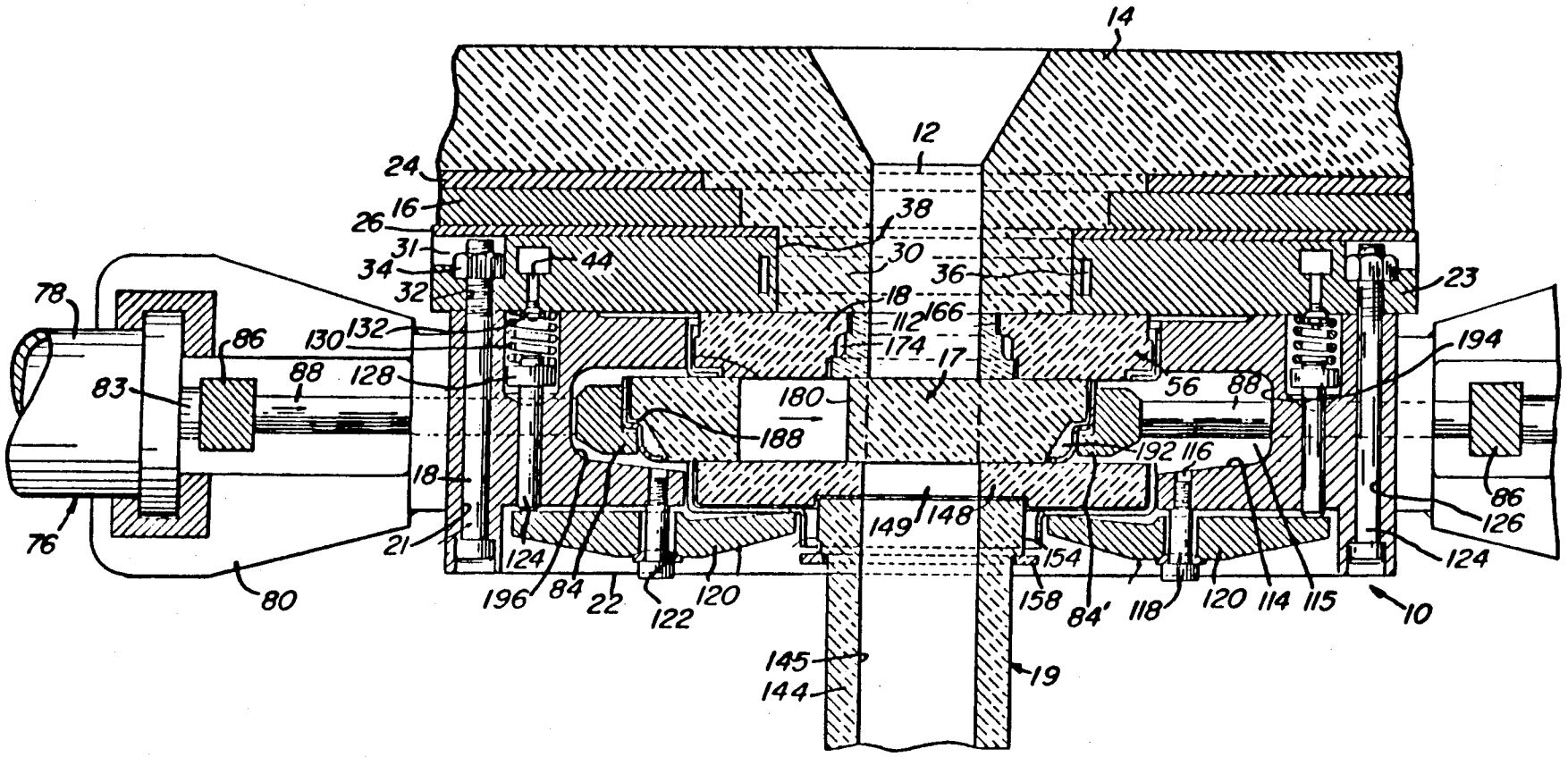
FIG. 2 is a vertical sectional view taken along line 2—2 of FIG. 1.

In FIGS. 1 and 2 of the drawings there is shown a sliding gate valve organization 10 adapted for installation in operative relation to the pour opening 12 in the lining 14 of a teeming vessel 16, such as a tundish or the like, for teeming molten metal to the mold of a continuous caster (not shown). Teeming is controlled by the manipulation of refractory slide plates, that may be orificed as shown at 17 in FIGS. 2, 6 and 7 or blank as shown at 17' in FIG. 1, with respect to a refractory top plate 18. The organization 10 also includes replaceable pour tube assemblies 19 that form extensions of the valve for conducting the teemed molten metal stream to a caster mold. The valve organization 10 is adapted for mounting to the vessel 16 by means of threaded connectors 20 extending through holes 21 in the frame 22 attaching the same to the mounting plate 23 which is, in turn, attached to the vessel by means of bolts (not shown) that connect with a nut plate 24 underlying the vessel lining 14. A heat insulating pad 26 formed of asbestos, or the like, may be interposed between the mounting plate 23 and the vessel 16.

Figure 4:
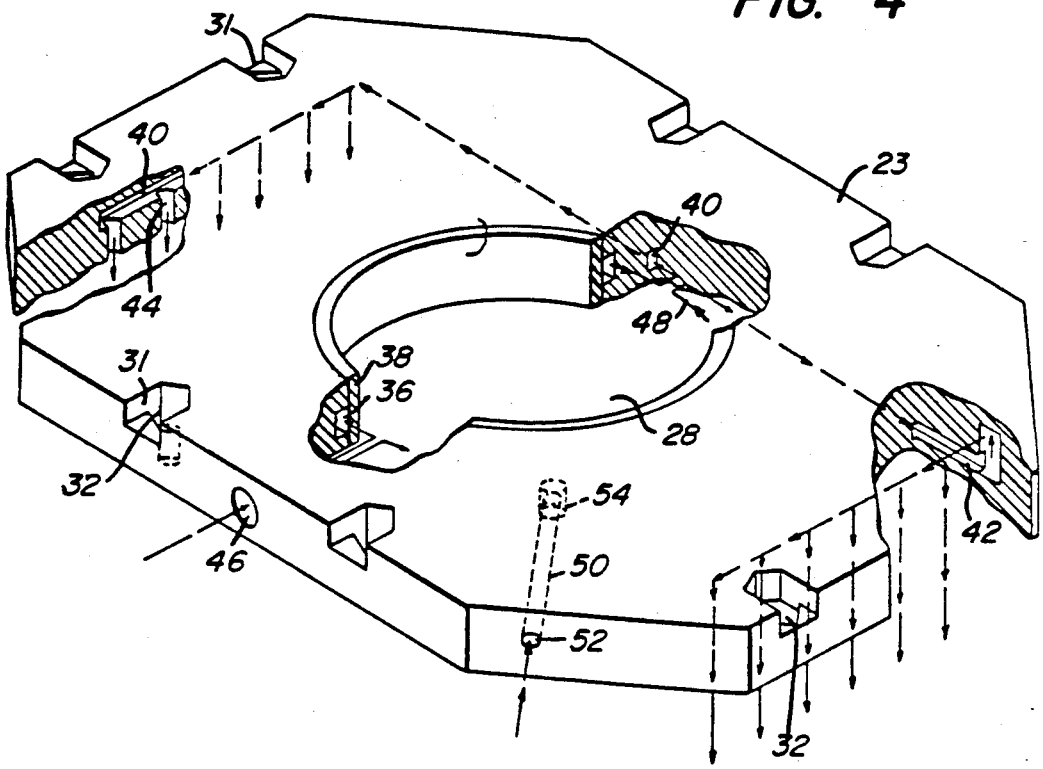
FIG. 4 is a partially broken perspective representation of the mounting plate embodied in the present invention illustrating the flow paths for cooling air and inert gas therethrough.

As best shown in FIG. 4, the mounting plate 23 is a generally flat metal plate having a central opening 28 for reception of the lower end 30 of the refractory material forming the vessel pour opening 12. The upper surface of the mounting plate 23 contains, along its side edges, recesses 31 that communicate with bolt holes 32 for reception of the connectors 18 and their associated nuts 34.

The mounting plate 23 is provided with a plurality of internal fluid passages for conducting cooling air and inert gas during periods of valve operation. A first passage 36, concentric with the central opening 28, is defined by a recess formed in the wall of the opening and covered by a ring 38 that is weldedly attached to the plate in order to seal the passage. In addition, the plate is formed with a pair of oppositely extended elongated passages 40 and 42 extending about three sides of the plate and terminating in downwardly discharging ports 44 for supplying cooling air to the valve springs as hereinafter more fully described. An air inlet port 46 is provided at one side of the plate for delivering cooling air to the fluid passages 36 & 40, 42 which, as shown by the arrows 48, are connected in series whereby cooling air is first conducted about the annular passage 36 and then in opposite directions through the passages 40, 42 before being discharged through the ports 44.

Also provided in the mounting plate 23 is an elongated passage 50 which, at one end, communicates with an inlet opening 52 at the side of the plate for connection with a source of inert gas and at the other end, with a downwardly directed discharge opening 54 adapted to communicate with gas supply means in the valve top plate 18 as hereinafter described.

Figure 8:
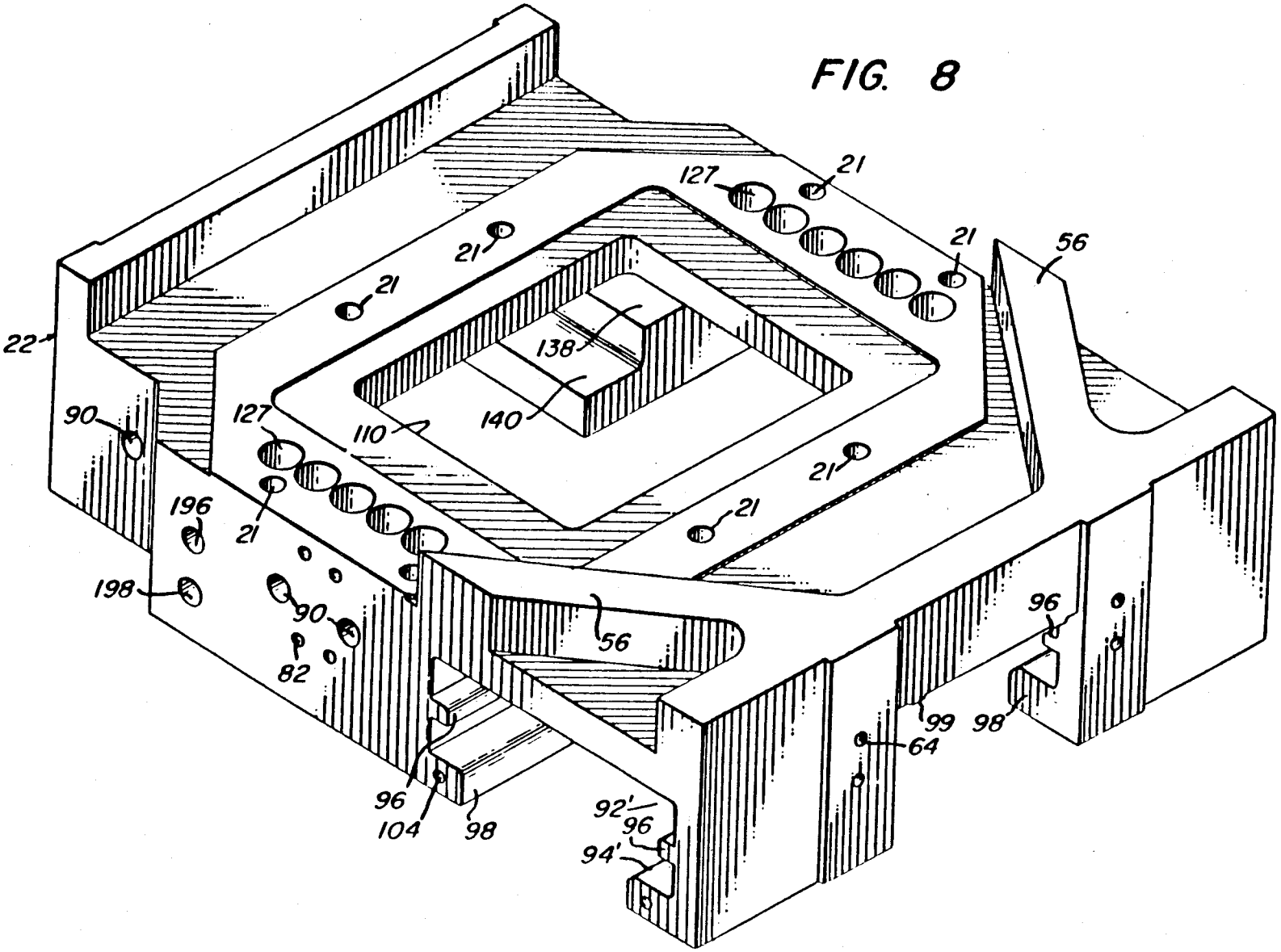
FIG. 8 is a perspective view taken from above of the valve frame structure of the present invention prior to assembly.
Figure 9:
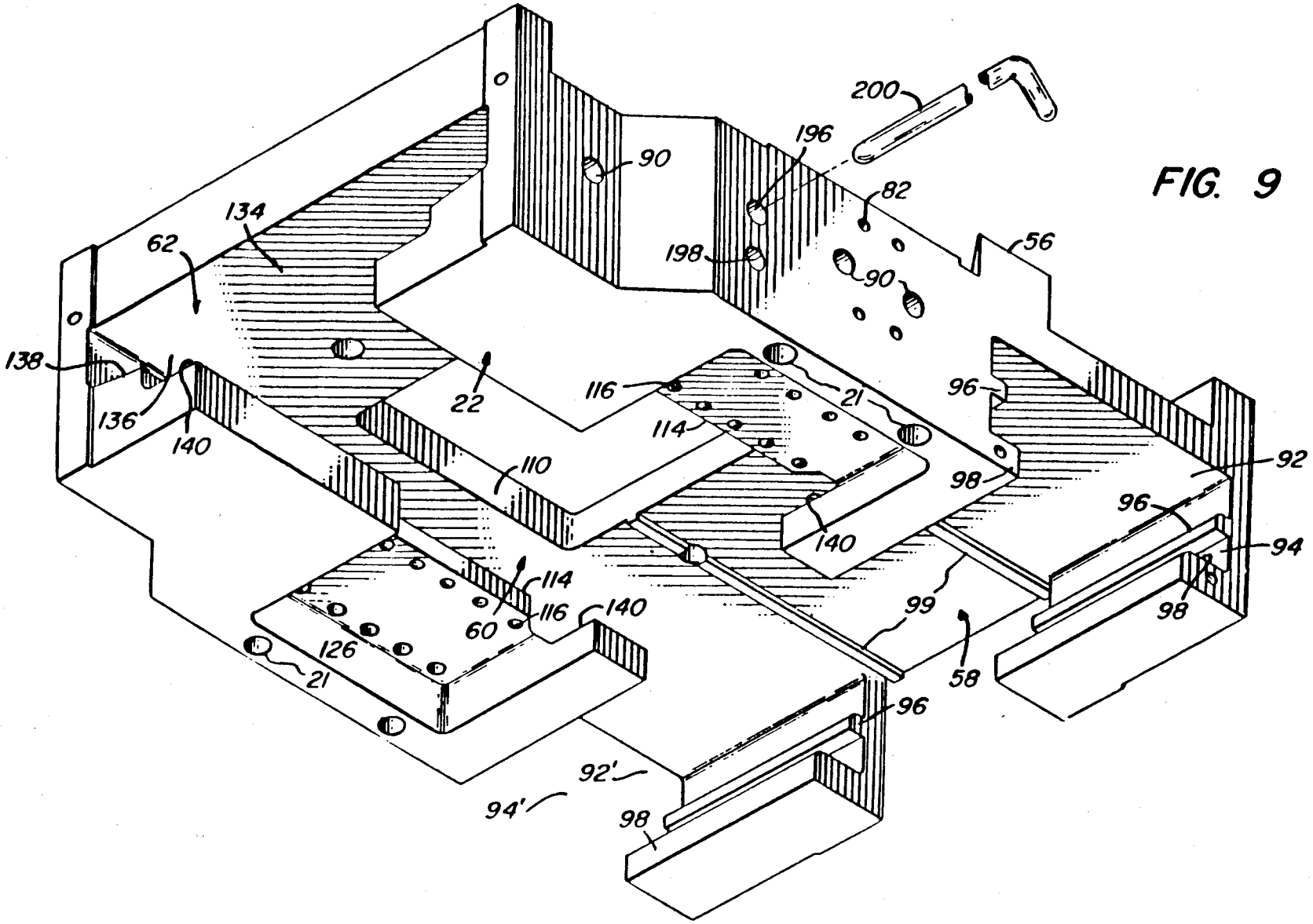
FIG. 9 is a perspective view taken from below of the valve frame structure of FIG. 8.

The valve frame 22, formed essentially of a machined metal casting stiffened by members 56 is best illustrated with particular reference to FIGS. 8 and 9. This frame 22 contains the operating parts of the valve organization and is adapted for attachment to the mounting plate 23, or release therefrom, as an assembled unit through the connectors 18. The frame 22 comprises three principle sections, indicated generally in FIG. 3 as plate loading section 58, operating section 60 and plate discharge section 62. Adjacent the plate loading section 58 the frame 22 attaches, through connectors (not shown) engageable with threaded holes 64 (FIG. 8), bracket means 66 for mounting feed motor 68. The feed motor 68 comprises a fluid operated cylinder 70 having a reciprocable piston attaching a piston rod 72 and pusher 74. A second set of motors, termed "throttling motors" are attached to the frame 22 adjacent the operating section 60 thereof. These motors 76 are oppositely acting and are operated independently of the feed motor 68. They each comprise an operating cylinder 78 mounted to the frame by bracket 80 which attaches to the frame side wall by connectors engageable with the holes 82. The cylinders 78 each contain a reciprocable piston whose rod 83 attaches a laterally elongate connecting brace 86 which connects slide pins 88 that are guidingly received in openings 90 in the frame side wall and attach throttling rails 84 and 84' that operate to manipulate a slide plate disposed in the operating section 60 of the frame. Rail 84' is of a length shorter than rail 84 in order to accommodate passage of a plate through the loading section 58 of the frame.

The interior of the frame 22 is configured to define communicating paths of travel for slide plates 17 or 17' and pour tube assemblies 19 between the respective frame sections 58, 60 and 62. The loading section 58 of the frame 22 heredescribed is defined by laterally extending guideways 92 and 94 adapted to pass slide plates 17, 17' and pour tube assemblies 19 respectively. The guideway 92 is vertically spaced from guideway 94 by oppositely extending slide rails 96 that serve to support the slide plates that are loaded in the valve. The bottom of guideway 94 is defined by a similar set of slide rails 98 that support pour tubes 19 for loading. Rub rails 99 along the roof of the frame in this section serve to vertically position a slide plate 17 as it is moved from the loading section 58 of the valve to the operating section 60 thereof.

It will be appreciated that frame 22, as depicted in FIGS. 8 and 9, is adapted for slide plate or pour tube insertion from either the right or left hand side by the provision of indentical guideways 92' and 94' on the opposite side of the frame. When the guideways 92 and 94 are selected for use, those guideways indicated as 92' and 94' on the opposite side of the frame are closed by a stuffer member 100 comprising a backing plate 102 threadedly connectable to the frame 22 at holes 104 (FIG. 8) and vertically spaced stop plates 106 and 108 that fill the guideways 92' and 94' effectively preventing movement of a pour tube beyond its desired position adjacent the pusher 74. Obviously, loading from the opposite side of the frame can be readily effected by simply moving the stuffer member 100 from passageways 92' and 94' to the opposite side of the frame where it will fill the passageways 92 and 94.

The operating section 60 of the frame 22 contains a rectangular opening 110 in the upper surface thereof for reception of a stationary refractory top place 18 whose central orifice 112 aligns with the pour opening 12 from the vessel and defines the inlet to the valve 10. Vertically spaced below the opening 110 the frame 22 is provided with oppositely spaced bases 114 that cooperate with the upper wall of the frame to define a cavity 115. The bases 114 are provided with laterally spaced threaded holes 116 which receive connectors 118 for mounting a series of spring biased levers 120 that operate to retain the pour tube assembly 19, slide plate 17 or 17' and top plate 18 in surface-to-surface sealed relation. The levers 120 pivot upon rockers 122 retained by the connectors 118 and are spring biased by headed push pins 124 movably mounted in holes 126 in the frame. The holes 126 are counter bored at their upper ends at 127 to provide seats for the push pin heads 128 and for springs 130 that bear between the push pin heads and the facing surface of mounting plate 23.

As shown in FIG. 2 the holes 126 in the frame 22 are caused to communicate with the ports 44 in the mounting plate 23 whereby cooling air is supplied to prevent overheating of the springs 130. Desirably, the ports 44 contain discharge orifices 132 in order to effectively distribute cooling air to the respective spring assemblies.

Opposite walls of the valve frame 22, adjacent the operating section 60, are provided with vertically spaced pairs of aligned holes, indicated as 196 and 198 respectively. Each pair of aligned holes is adapted to receive a selectively positionable stop pin 200 that traverses the respective paths of travel of the slide plate or pour tube assembly and is operative during plate changing procedures to obstruct movement of either the slide plate 17 or pour tube assembly 19 when it is desired to replace the other. Similar holes 196' are provided in rails 84 and 84' to accommodate passage of the stop pin 200 through these members. When the simultaneous replacement of both the slide plate 17 and the pour tube assembly is desired the stop pin 200 is withdrawn from the frame completely leaving both paths of travel free of obstruction. Under normal operating conditions the stop pin 200 is retained in the lower pair of holes 198 to leave the slide plate travel path free of obstruction in order to permit rapid termination of molten metal flow as hereinafter described.

The discharge section 62 of the frame 22 is formed by vertically spaced guideways 134 and 136 opening at the end of the frame. The guideways 134 and 136 are defined by stepped shoulders 138 and 140 formed in the longitudinal extensions of the bases 114 and are adapted to slidably guide the slide plates 17 or 17' and pour tube assemblies 19 respectively from their positions in the operating section 60 of the valve to a point of discharge as hereinafter described.

Figure 3:
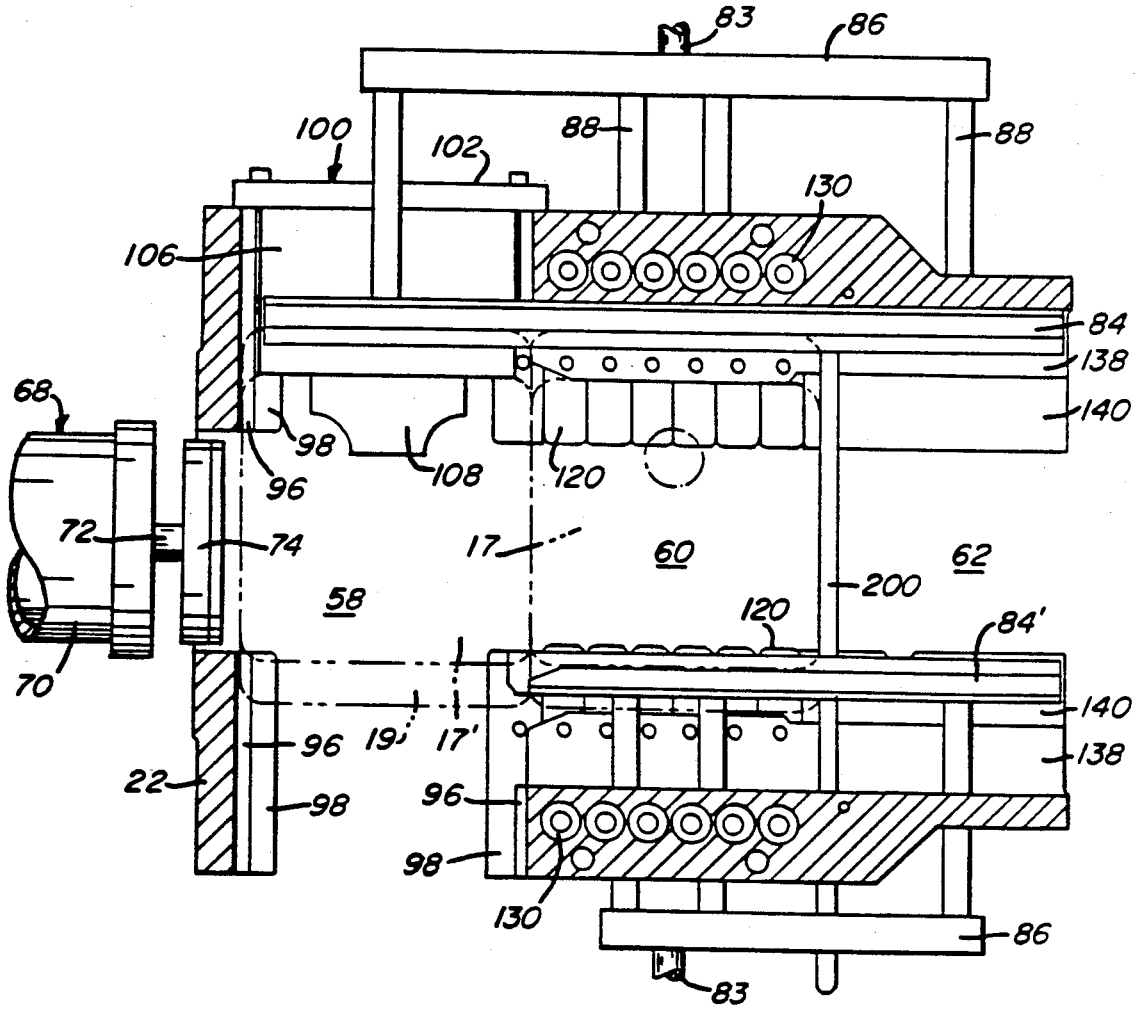
FIG. 3 is a plan sectional view taken along line 3—3 of FIG. 1.

As shown best in FIG. 3, the throttling rails 84 and 84' are disposed in the frame 22 at substantially the same elevation as slide plate loading guideway 92. Rail 84 is longer than rail 84' extending substantially the full length of the frame interior. Rail 84', on the other hand, is shorter than rail 84 by an amount to permit passage of a slide plate 17 from the guideway 92 into position with respect to pusher 74 upon loading of these members. Rail 84 is further provided along that portion of its length that faces the guideway 92 with a plurality of longitudinally spaced magnets 142 here shown as being six four-pole permanent magnets, the function of which is to prevent dislodgement of a slide plate 17 or 17' in the loaded, "ready" position, hereinafter described, from the rail 84 as it is moved during the performance of the throttling function of the valve.

The slide plates 17, 17', top plate 18 and pour tube assemblies 19 of the valve organization 10 each essentially comprise a refractory material encased in a metal frame. The pour tube assembly 19 contemplated for use in the described organization is of essentially conventional construction consisting of an elongated cylindrical tube 144 having an axial opening 145. The tube 144 is of a length to permit its lower end to extend into a caster mold, or the like, (not shown). The upper end of the tube 144 is adapted for reception into a recess 146 in the lower surface of a generally flat, rectangular refractory plate, termed the tube holder plate 148. The plate 148 contains a through-opening 149 coaxial with tube opening 145 and is enclosed about the exposed portion of its bottom and about its peripheral sides by a metal casing 150. As shown in the drawing, a mortar cement is employed to seal the joint between the upper end of the tube 144 and the holder plate 148 and to attach the holder plate within the metal enclosure. The metal enclosure may be provided with a depending skirt 152 which serves to protect the mortared joint and to stiffen the enclosure bottom surface. A heat resistant material such as asbestos rope (not shown) can be used to fill the space 153 between the skirt and the tube. A secondary attachment between the tube 144 and the holder plate can be effected by provision of a collar 154 defining a shoulder 156 adajacent the upper end of the tube for engagement by a retention ring 158 which is releasably secured to the metal casing 150 by threaded fasteners, or the like (not shown). The openings 145 in the pour tube 144 and 149 in plate 148 are preferably formed of a diameter slightly greater than that of the slide plate orifice in order to permit metal drainage from the passage upon throttling the valve to a fully closed condition.

Figure 5:
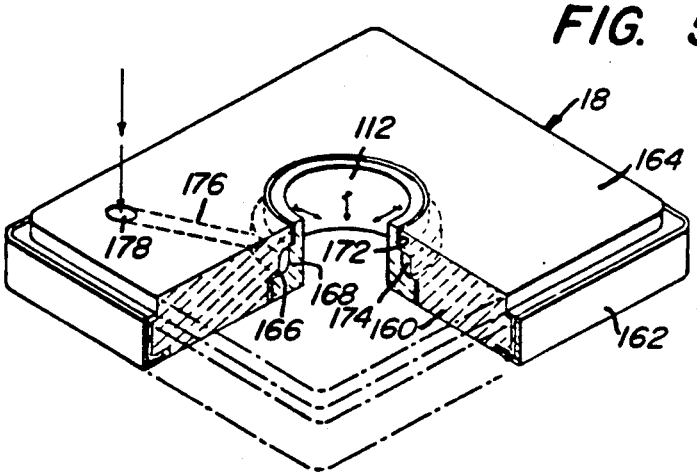
FIG. 5 is a partially broken perspective representation of a top plate embodied in the present invention.

The top plate assembly 18 of the present organization is shown in FIGS. 1, 2 and 5. The assembly 18 comprises a rectangular refractory plate 160 set by mortar in a metallic casing 162 of generally L-shaped cross section that extends about the peripheral sides of the plate. The upper surface 164 of the plate 160 extends above the upper edge of the casing and is provided with a polished finish to provide a smooth surface-to-surface contact with the lower surface of mounting plate 23 and the vessel refractory lining 14 when the assembly is in its operative position in the valve organization. Plate 160 is provided with a centrally disposed stepped through opening 166 in order to receive a permeable refractory insert 168 having an axial opening defining the molten metal flow passage 112 through the plate. The insert 168 has an exterior surface 172 that is stepped in a fashion complimentary to that of the plate opening 166 with the outermost steps being adapted for cemented engagement with the mating steps of the opening but with the intermediate step of a significantly smaller diameter than that of the intermediate step of the opening. In this way there is defined an annular passage 174 about the circumference of the insert 168 for the supply of inert gas through the insert into the metal flow passage 112. The refractory plate is provided with an oblique channel 176 that opens at the top of the plate at 178 and being positioned to communicate with the opening 54 in the lower surface of the mounting plate 23 when the valve is assembled. There is thus provided a convenient means for supplying inert gas into the metal flow passage 112 during periods when the valve is closed thereby to stir the metal in flow passage and thus prevent its freezing. By forming the annulus in this fashion, so-formed refractory top plates can be fabricated by conventional refractory forming methods without the need for expensive machining with collapsible or multi-part machine tooling.

Figure 6:
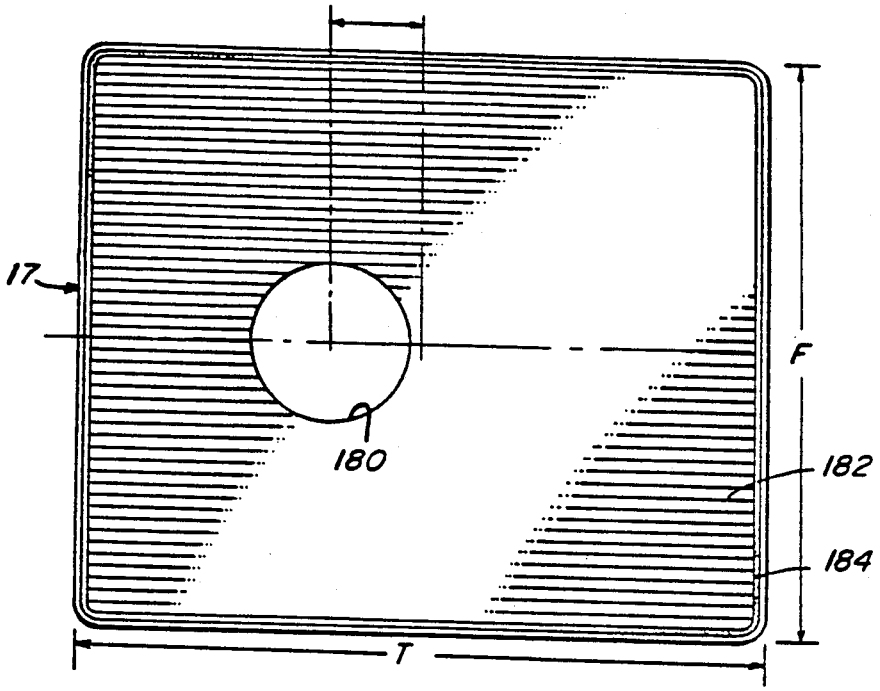
FIG. 6 is a plan view of a sliding plate constructed according to the present invention.
Figure 7:
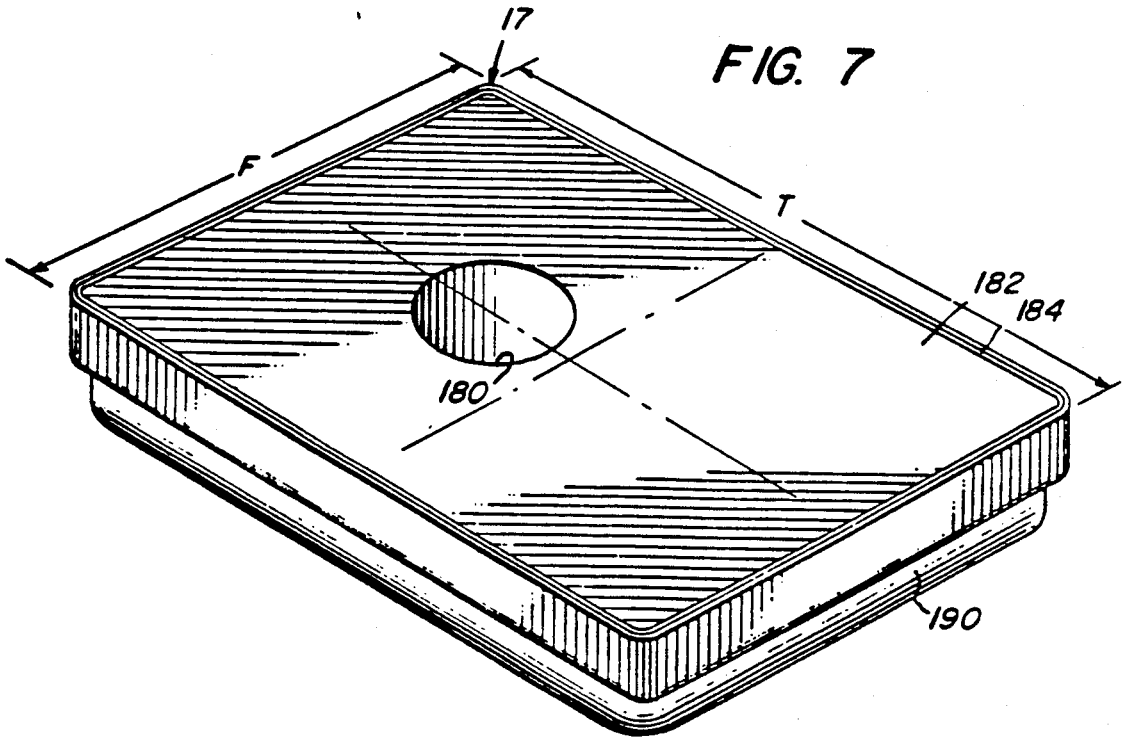
FIG. 7 is a perspective view of the sliding plate of FIG. 6.

The slide plate assemblies utilized in the valve organization may be blank or imperforate as the type shown at 17' in FIG. 1 or may contain a through opening 180 as the type shown at 17 in FIGS. 2, 6 and 7. Blank plates 17' are employed, as shown in FIG. 1, to prevent metal flow through the valve while orificed plates 17 are employed when it is desired to controllably pass molten metal through the valve as hereinafter described. Both slide plate assemblies 17 and 17' are fabricated in an identical manner comprising a generally rectangular refractory plate 182 which is slightly longer in the feed direction indicated as F in FIGS. 6 and 7 than in the throttling direction indicated as T. The plate 182 is cemented within a metal casing 184 that encloses the peripheral sides of the plate. The casing 184 is provided with a shoulder 186 intermediate its upper and lower edges for seating engagement on the throttling rails 84 and 84' and for sliding engagement upon the slide rails 96 in the loading section 58 of the valve and the shoulders 138 in the discharge section 62 thereof. The refractory plate 182 is formed at 188 with a mating shoulder conforming to that in the casing.

The lower portion of the casing, indicated as 190, is formed with an enlarged radius curvature providing a guiding surface to enable the respective slide plate assemblies when being moved to pusher 64 into the operating section 60 of the valve to be guidingly urged up and over the upper edge of the pour tube holder assembly without causing damage to either member.

The lower portion of the plate 182 adjacent the enlarged radius portion 190 of the casing is tapered as shown thus to provide an enlarged receptacle 192 for mortar between the plate and the metal casing. The enlarged mortar bed in this region of the assembly operates to cushion the plate during movement of the plate across the tube holder assembly 19 and when the plate is manipulated by the movable rails 84, 84' during periods of throttling.

Slide plate assembly 17 differs from assembly 17' in that the latter is imperforate while the former contains the molten metal flow opening 180. The position of the opening 180 in the refractory plate is critically located along the longitudinal centerline of the plate but offset from the center point of the plate toward the left in FIG. 2 by an amount equal to one-half the length of stroke of the throttling pins 88 thereby permitting the opening 180 to be vertically aligned with the top plate opening 112 for full flow of metal through the pour passage with the plate fully stroked to the right as viewed in FIG. 2 with the rail 84' in abutment with the wall 194 on the cavity 115. With the plate 17 being fully stroked to the left and the rail 84 abutting wall 196 the opening 180 is moved completely out of registry with the opening 112 thereby effecting termination of molten metal flow through the valve. By operation of the throttling motors 76 the position of the opening 180 in the plate 17 can be adjusted to any desired location with respect to the top plate opening 112 intermediate these full stroke positions thereby to alter the effective size of the molten metal flow passage through the valve for regulating molten metal flow therethrough.

A typical commercial embodiment of the slide plate assembly 17 is approximately 10.9 inches along in the feed direction F and 12.9 inches long in the throttling direction T with the center of the opening 180 having a three inch diameter being offset from the plate center point approximately 1.75 inches thereby providing about one-half inch of refractory material between the holes 112 and 180 with the plate 17 in the shutoff position.

The operation of the hereindescribed valve organization 10 is as follows:

The valve frame 22 is attached to the mounting plate 23 at the bottom of the teeming vessel 16 as shown in FIG. 1 with the top plate 18, a blank slide plate 17' and a pour tube assembly 19 preassembled in the operating section 60 of the valve frame. The flow passage 112 through the top plate 18 is thus vertically aligned with the pour passage 12 through the vessel lining 12. When molten metal is deposited in the vessel its flow through the valve is prevented due to the obstruction in the flow passage presented by the flow-impervious blank slide plate 17'. During such metal holding periods an inert gas, such as argon or nitrogen, is admitted to the pour passage 112 of the top plate through passages 52 in the mounting plate 23 and 176 in the top plate into the annulus 174 about insert 168 from whence it permeates the pourous wall of the insert to enter the passage 112. Entry of inert gas in this fashion serves to stir the molten metal in the obstructed flow passage and thereby prevents its freezing therein. Also, cooling air is admitted to the valve through inlet 46 in the mounting plate 23 from whence it flows seriatim through annular passage 36 about the lower region of the vessel lining 14 to cool the refractory material in this region and thence through passages 40, 42 to discharge from ports 44 to cool the springs 130.

With the throttling mechanism disposed to place the rails 84 and 84' in the position shown in FIG. 2 with rail 84 in abutment with cavity wall 196, an orificed slide plate 17 is inserted manually into the valve loading section 58. The slide plate 17 is inserted through the guideway 92 with the plate shoulders 186 in sliding engagement upon the slide rails 96. The slide plate 17 is moved until its leading edge surface abuts the rail 84, being retained thereagainst by the magnets 142, thus placing the slide plate 17 in its "ready" position adjacent the pusher 74 of the feed motor 68. Thereafter, the feed motor 68 is actuated to cause the pusher 74 to move the slide plate 17 from its "ready" position into the operating section 60 of the valve frame 22 between the top plate 18 and pour tube assembly 19 by displacing the blank plate 17 which slides along the shoulders 138 to the discharge section 162 from whence it exits the frame. An effective surface-to-surface seal between the respective plates is provided by the spring-biased levers 120 which urge the tube holder plate 148 upwardly against the slide plate 17 and that, in turn, upwardly against the top plate 18. Due to the presence of the enlarged radius 190 on the casing 184 of the slide plate 17 the moving plate is guided across the facing edge of the spring biased pour tube holder plate 148 without damaging that plate. The feed motor 58 is then actuated in the reverse direction to retract the pusher 74 to the position shown in FIG. 1 whereupon, for safety reasons, a blank slide plate 17', as shown in FIG. 3, is inserted into its "ready" position in the valve frame 22 in the same manner as described above in connection with the insertion of the slide plate 17.

When it is desired to initiate molten metal flow through the valve the flow of inert gas to the passage 112 is terminated and the throttling motors 76, which operate in unison, are actuated to move the rails 84, 84' and the retained slide plate 17 laterally of the cavity 115. Normally, the motors 76 will be actuated to move the rails 84, 84' to place rail 84' into abutment with wall 194 of cavity 115 thereby placing the orifice 180 of slide plate 17 in axial alignment with the opening 112 in the top plate 18. This defines the "full-open" position of the valve. Alternatively, however, it will be appreciated that, where molten metal flow is desired at a rate less than full flow, the throttling motors can be controlled to locate the slide plate 17 at any intermediate position between "full open" and "full close" to produce the desired intermediate flow rate. Furthermore, during the course of teeming the position of the slide plate can be altered, either to increase or decrease the rate of molten metal flow through the valve as desired by controlling the operation of the throttling motors 76 which impart throttling movement to the slide plate 17 and its orifice 180 with respect to the top plate pour opening 112.

The invention permits ready replacement of both the slide plate 17 and the pour tube assembly 19, either singly or jointly. When it is desired to replace a spent slide plate 17 the stop pin 200 is inserted through holes 198 in the valve frame 23 to prevent movement of the pour tube assembly. The blank plate 17' is withdrawn from the "ready" position adjacent the pusher 74 and a replacement slide plate 17 inserted in its stead. The feed motor 70 is then actuated to move the replacement plate into the operating section 60 of the valve while discharging the spent plate through the discharge opening 62.

This procedure can be accomplished with the throttling rails 84, 84' disposed in any lateral position across the operating section 60 since the replacement plate 17 is retained on the rail 84 by means of the magnets 142. Thus, when installed in the operating section 60, the replacement plate 17 will assume the same throttling position of the spent plate it replaced.

When it is desired to replace a pour tube assembly 19, the throttling rails 84, 84' are operated by the throttling motors 76 to move the slide plate 17 to the fully closed position shown in FIG. 2 and the safety blank 17' withdrawn from the valve frame. The stop pin 200 is next removed from holes 198 and inserted in holes 196, 196' to prevent movement of the operative slide plate 17. The replacement pour tube assembly 19 is then manually inserted through guideway 94 of the loading section 58 of the valve frame 23 to a position adjacent the pusher 74 whereupon the feed motor 70 is actuated to move the replacement pour tube assembly 19 into its operative position beneath the slide plate 17 in the section 60 while expelling the spent pour tube assembly through the guideway 136 of the discharge section 62.

When, alternatively, it is desired to change both a slide plate 17 and a pour tube assembly 19, the throttling motors 76 are actuated to move rails 84, 84' and the operative slide plate 17 to the fully closed position and the stop pin 200 is withdrawn from the valve frame. The replacement slide plate 17 and pour tube assembly 19 are inserted through guideways 92 and 94 respectively in the loading section 58 to their "ready" positions adjacent the pusher 74. Upon actuation of the feed motor 68, the replacement slide plate and pour tube assembly are simultaneously moved into position into the operating section 60 while expelling their spent counterparts through guideways 134 and 136 of the discharge section 62.

An important characteristic of the hereindescribed valve organization is the ability to rapidly terminate molten metal flow through the valve and independently of its throttling function. This charactristic is achieved by virtue of the fact that the operation of the feed motor 68 which effects plate replacement in the valve is totally independent from that of the throttling motors 76 and that slide plates 17 can be changed regardless of the throttling position of the operative slide plate located in valve section 60. Thus, during the course of normal valve operation a blank slide plate 17' is preferably retained in the "ready" position adjacent pusher 74. This plate, like all plates in the "ready" position, is secured to the rail 84 by the magnets 142 and thus is caused to move laterally back and forth with the operative slide plate 17 thereby insuring that the former is always longitudinally aligned with the latter. If for any reason it becomes necessary to rapidly terminate the flow of molten metal, as for example, due to malfunction of the casting process, the feed motor 68 need only be actuated to replace the operative orificed slide gate 17 with the blank gate 17'. The advantage of this feature can be appreciated when it is considered that a plate change can be effected by the feed motor in less than .2 second as contrasted with a period of approximately 2 seconds duration that is required to move the operative slide plate from its fully open position to its fully closed position by the throttling motors 76.

Figure 10:
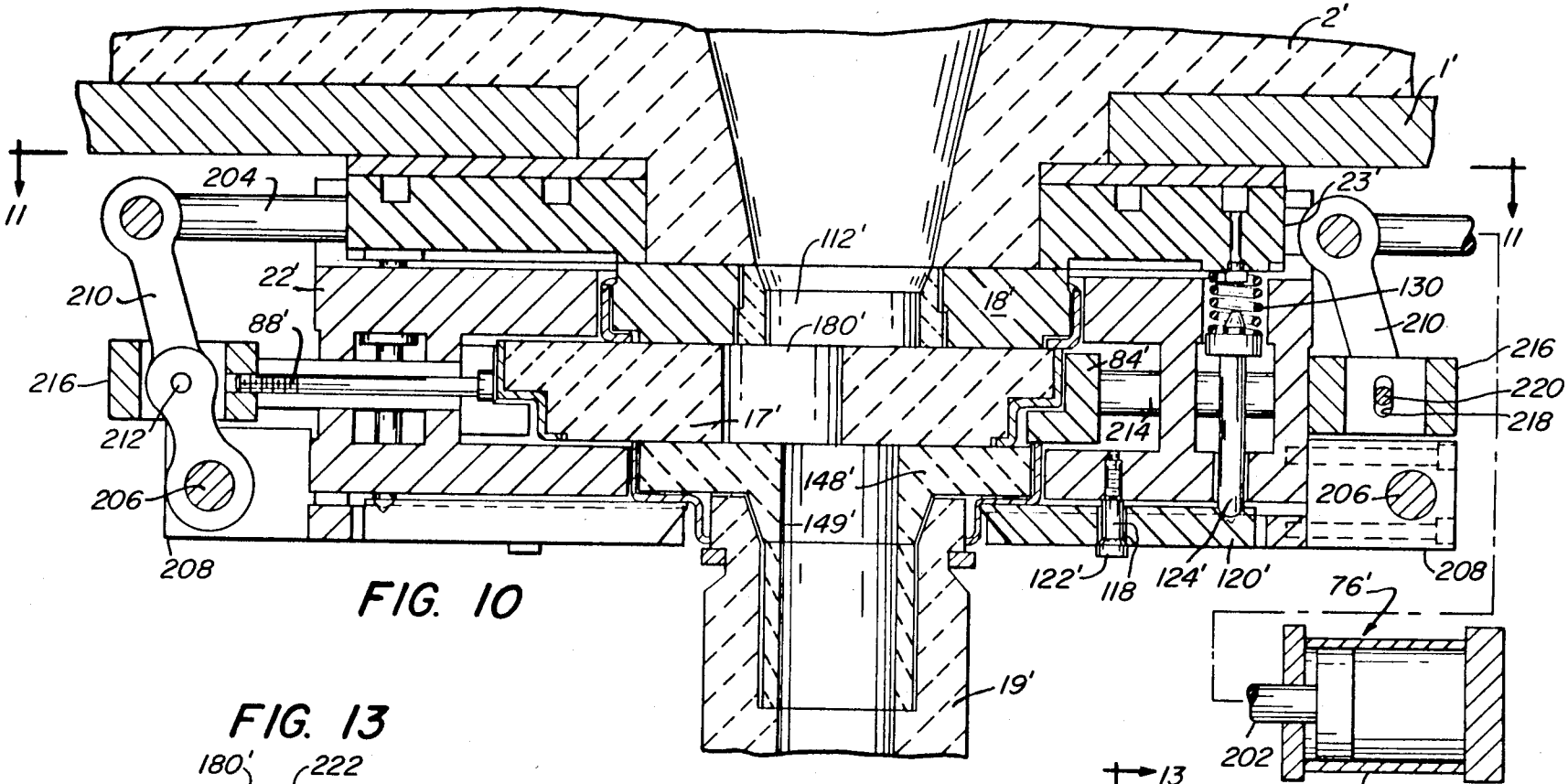
FIG. 10 is a plan view of a slightly modified embodiment of the invention.
Figure 11:
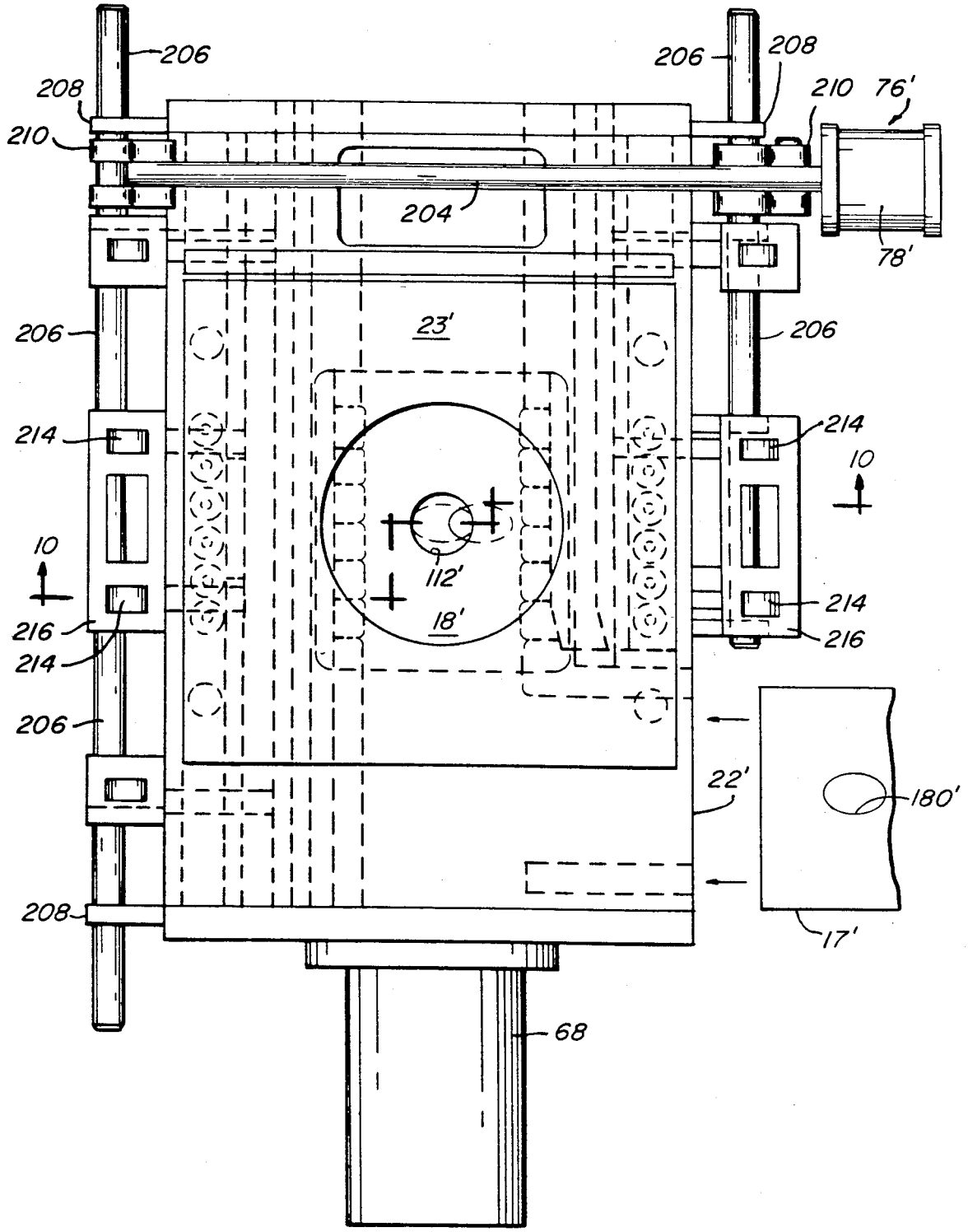
FIG. 11 is a vertical sectional view taken along line 11—11 of FIG. 10.

In FIGS. 10 and 11 there is illustrated an alternative, although slightly less desirable, embodiment of the invention in which parts similar to those employed in the preferred embodiment are indicated by the same numerical designation but with a superposed prime. This valve arrangement which represents an earlier valve form improved upon by the hereinabove described preferred embodiment of the invention has substantially the same operating characteristics of the preferred embodiment but employs a different throttling motor arrangement and is characterized by restricted slide plate movement in the throttle direction preventing complete closure of the valve flow passage except by means of replacement of the orificed plate with a blank plate.

As shown, the valve frame 22' mounts a throttling motor organization, indicated generally as 76', that is operative to move the throttling rails 84' containing orificed slide plate 17' with respect to the opening 112' in the top plate 18'. The throttling motor organization 76' includes a single operating cylinder 78' fixedly secured with respect to the frame 22'. The piston 202 operative in cylinder 78' is operatively connected to a cross link 204 that extends transversely across the valve frame 22' through an opening (not shown) in the mounting plate 23'. The cross link 204 is operative to oscillatably drive a pair of crank shafts 206 journalled each in bearing brackets 208 that are mutually spacedly disposed on opposite sides of the frame 22'. The crank shafts 206 are driven by a pair of bell cranks 210 connected each at one end to the cross link 204 by pins 212 and fixedly secured at their other ends to the respective crank shafts. The crank shafts 206 impart movement to the respective slide plate support rails 84' through crank arms 214 that connect the crank shafts 206 to each of a plurality of yokes 216, each of which is disposed at the outboard end of each of the respective slide pins 88' to which the rails 84' are secured. An elongated slot 218 in each yoke 216 receives a pin 220 fixed to the respective crank arms 214 to impart linear movement to the respective yokes 216 while the crank arms oscillate.

Retention of the pour tube assembly 19', slide plate 17' and top plate 18' in surface-to-surface sealed relation is effected in a manner similar to that employed in the embodiment of FIGS. 1 and 2 by means of a series of spring biased levers 120'. The levers 120' are secured to the frame 22' by connectors 118' having rockers 122' upon which the levers are permitted to pivot. The force from springs 130' housed within the frame 22' is transmitted to the outboard ends of the levers 120' through push pins 124' thereby causing the inboard ends of the levers to impart the spring force upwardly seriatim through the pour tube support plate 148', the slide gate 17' and the top plate 18'.

It will be appreciated that the orifice opening 180' in the illustrated slide plate 17' is centrally disposed thereby limiting the extent of its movement with respect to the opening 112 in top plate 18 at the full stroke position of the throttling motor 76' and slide plate 17' thereby limiting the flow restriction in the metal flow passage to one that is less than full throttle or complete closure of the passage.

Figure 12:
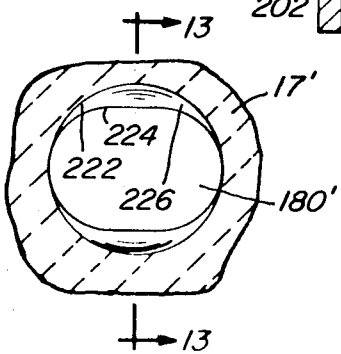
FIG. 12 is a plan sectional view of the orifice opening through the slide plate in the embodiment of FIG. 10.
Figure 13:
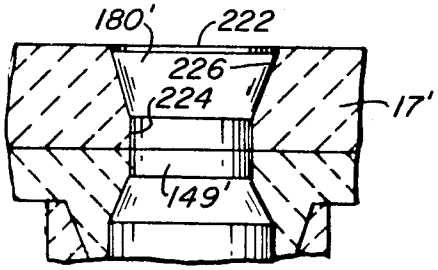
FIG. 13 is a vertical sectional view taken along line 13—13 of FIG. 12.

As illustrated best in FIGS. 12 and 13 the orifice opening 180' in the slide plate 17' may be of a compound shape, being circular at its upper end 222 for registry with the circular opening 112 in top plate 18 and at the bottom end 224 elongated in the direction of travel of the plate in the flow throttling direction. The opening 180' at the bottom end 224 is, as shown in FIG. 12, shaped as a straight sided member whose ends are circular. Alternatively, the opening at the bottom end 224 may be elliptical. The major axis of the elongated portion of the opening 180' has a length corresponding to the diameter of the opening at the upper end 222 of the plate. The wall of the opening 180' between the upper and lower ends of the slide plate 17' is downwardly constricted, as at 226, to produce a smooth transition in the shape of the flow stream in order to minimize the creation of turbulence therein. As is evident in the figures, especially FIGS. 10 and 13, the pour tube support plate 148' is provided with an opening 149' that corresponds in shape to the elongated opening at the lower end 224 of the slide plate 17'.

The described configuration of the slide plate opening 180' is desirable to maximize the effectiveness of the opening at the termination of the pouring effort and, conversely, to permit a relatively small total opening when teeming through a plate is initiated. With reference to FIG. 10 it will be observed that the described opening configuration in the slide plate and pour tube support plate will cooperate to produce a flow stream whose cross section closely approximates a circular shape when the slide plate is in the full stroke position, but as the orifice is opened by movement of the plate in the throttle direction in response to the buildup of deposits as would otherwise tend to clog the metal flow passage the flow passage assumes a cross sectional shape similar to that illustrated in FIG. 12, obstructed only to the extent to which clogging has occurred. The result is that a more compact flow stream can be produced over the full throttle range of the valve with a concomitant reduction in the degree of diffusion of the flow stream exiting the discharge end of the valve apparatus.

It will be appreciated that the described valve organizations have particular utility in varying the effective flow area through the valve in response to clogging or erosion of metal pour passage thereby to effectively control the flow of metal from the teeming vessel. Thus, when a metal, such as aluminum-killed steel, having a high propensity for clogging the metal pour passage is poured, the slide plate, after being placed in its operative position in the valve by operation of the plate feed motor, is adjusted by operation of the throttling motor or motors to a position creating a restricted flow passage through the valve, the cross sectional area of which corresponds to that capable of producing the intended controlled flow rate. Thereafter, as clogging occurs, the flow passage is progressively opened by operation of the throttling motors to maintain desired flow rate. When clogging progresses to the extent that the desired metal flow rate can no longer be maintained the spent slide plate is replaced by a fresh plate by operation of the plate feed motor and teeming proceeds.

Conversely, when a metal having erosive characteristics is teemed, the slide plate is initially placed in a position in which its orifice opening is substantially aligned with that of the vessel pour opening. Thereafter, as the passage-defining material erodes tending to enlarge the flow passage the slide plate is moved by operation of the throttling motor or motors to constrict the flow passage and thereby maintain the desired flow rate.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A gate operative in valve apparatus of the type in which apertured gates are conveyed sequentially along a longitudinally extending guide structure into and out of flow controlling relation with the pour opening of a teeming vessel and wherein, in order to adjustably position said gates with respect to said pour opening for flow throttling purposes, said guide structure is movable transversely of the direction of movement of said gates along said guide structure, said gate comprising:

(a) a generally rectangular refractory body having a through opening defining a teeming orifice therein;

(b) means forming shoulders extending parallel to the longitudinal axis of said refractory body for engagement with said guide structure; and, (c) said teeming orifice being disposed on a lateral axis of said refractory body in offset relation to said longitudinal axis, the extent of offset being in excess of the radius of said teeming orifice.

2. A gate according to claim 1 including a metal casing encircling the periphery of said refractory body and said shoulder means for engagement with said guide structure being formed on said casing.

3. A gate according to claim 2 in which said casing includes a portion forming a convexly arcuate cam surface subjacent said shoulder means at least along those sides spaced along the longitudinal axis of said body.

4. A gate according to claim 3 in which the arcuate cam surface of said casing is disposed in spaced relation from said refractory body; and a cushion of mortar filling the defined space.

5. A refractory plate for use in valve apparatus for controlling the flow of liquid from the pour opening of the teeming vessel and operative for the injection of fluid material into said pour opening, comprising:

(a) a refractory body having an axial opening therethrough;

(b) said axial opening being formed with at least three axially spaced steps of progressively greater diameter from one end of said opening to the other;

(c) a pourous plug for reception in said axial opening, said plug having an exterior surface formed of axially spaces steps of progressively reduced diameter from one end of said plug to the other;

(d) the peripheral suraces of the endmost steps on said plug being cementedly connected to the; and corresponding steps in the axial opening in said body; and (e) a step on said plug intermediate said endmost steps being formed of a diameter significantly less than the corresponding step in the axial opening and cooperating therewith to define an annular passage.

6. A refractory plate according to claim 5 including means forming a passage through said body extending between said annular passage and the exterior of said body.

7. A refractory plate according to claim 6 including an axial opening through said plug defining a liquid flow passage.

8. A refractory plate according to claim 7 including a metal casing cementedly attached about the periphery of said refractory body.

9. A refractory plate according to claim 5 in which the steps on either or both said refractory body and said pourous plug are formed by moulding.

10. A gate operative in valve apparatus in which the flow of metal from the pour opening of a teeming vessel to a receiver is controlled by the throttling movement of the gate with respecct to the vessel pour opening and the receiver inlet and in which the vessel pour opening is circular and the receiver inlet is defined by an opening elongated in the direction of throttling movement of the gate, said gate comprising:

a generally rectangular refractory body, a through-opening in said body defining a metal flow orifice, said through-opening at its upper end being substantially circular at its lower end being elongated in the direction of throttling movement of the gate with the major axis of said elongated position of said opening corresponding to the diameter of the circular position thereof, and the wall of said through-opening between said upper and lower ends being downwardly converging to maintain a smooth transition between the upper and lower ends thereof.

* * * * *

US004545512B1

REEXAMINATION CERTIFICATE (1896th)

United States Patent [19]

Shapland et al.

[11] B1 4,545,512

[45] Certificate Issued Jan. 12, 1993

[54] FULL THROTTLE VALVE AND METHOD OF TUBE AND GATE CHANGE

[75] Inventors: Earl P. Shapland, Sarasota, Fla.; Patrick D. King, Rantoul, Ill.

[73] Assignee: USX Corporation, Pittsburgh, Pa.

Reexamination Request:
No. 90/002,359, Jun. 6, 1991

Reexamination Certificate for:

| | |
|---|---|
| Patent No.: | 4,545,512 |
| Issued: | Oct. 8, 1985 |
| Appl. No.: | 525,867 |
| Filed: | Oct. 27, 1983 |

Reexamination Certificate B0 4,545,512 issued .

Related U.S. Application Data

[60] Division of Ser. No. 225,895, Jan. 19, 1981, Pat. No. 4,415,103, which is a continuation-in-part of Ser. No. 73,588, Sep. 7, 1979, which is a continuation-in-part of Ser. No. 945,441, Sep. 25, 1978, abandoned, which is a continuation-in-part of Ser. No. 732,867, Oct. 15, 1976, abandoned.

[51] Int. Cl.[5] ..... B22D 41/24

[52] U.S. Cl. ..... 222/600; 222/603; 222/561

[58] Field of Search ..... 266/236, 266; 222/600, 222/603, 561, 559, 564, 566, 575, 591, 594; 164/335, 337, 437

[56] References Cited

U.S. PATENT DOCUMENTS

| | | | |
|---|---|---|---|
| 311,902 | 2/1885 | Lewis | 222/60( |
| 808,810 | 1/1906 | Brookfield | 222/600 X |
| 1,944,611 | 1/1934 | Reinartz et al. | 222/59 |
| 3,731,912 | 5/1973 | Kutzer | 222/60( |
| 3,765,579 | 10/1973 | Cramer et al. | 222/60( |
| 3,779,431 | 12/1973 | Tinnes et al. | 222/60( |
| 3,866,806 | 2/1975 | Shapland, Jr. | 222/60( |
| 3,918,613 | 11/1975 | Shapland, Jr. | 222/60 |
| 4,168,790 | 9/1979 | Lothmann et al. | 222/60( |

FOREIGN PATENT DOCUMENTS

| | | | |
|---|---|---|---|
| 2702436 | 7/1977 | Fed. Rep. of Germany | 222/60 |
| 51-48131 | 12/1976 | Japan . | |

*Primary Examiner*—Scott Kastler

[57] ABSTRACT

A sliding gate valve of the type in which refractory gates are sequentially disposed in operative position beneath the pour opening from a teeming vessel, such as a tundish, is effective to controllably throttle the metal flow stream from the vessel. Operator means for positioning the gates in order to control the degree of throttling of the flow stream are independent from the operator means for disposing the gates in their working position within the valve mechanism whereby the flow stream can be terminated without adjusting the throttling configuration of the valve. Means are provided when the valve employs a pour tube attachment, for selectively changing gates and pour tubes in unison, or independently from one another. The valve mechanism and its replaceable refractory components are designed for the supply of fluids for cooling these members and for the injection of fluid reactants into the metal pouring process.

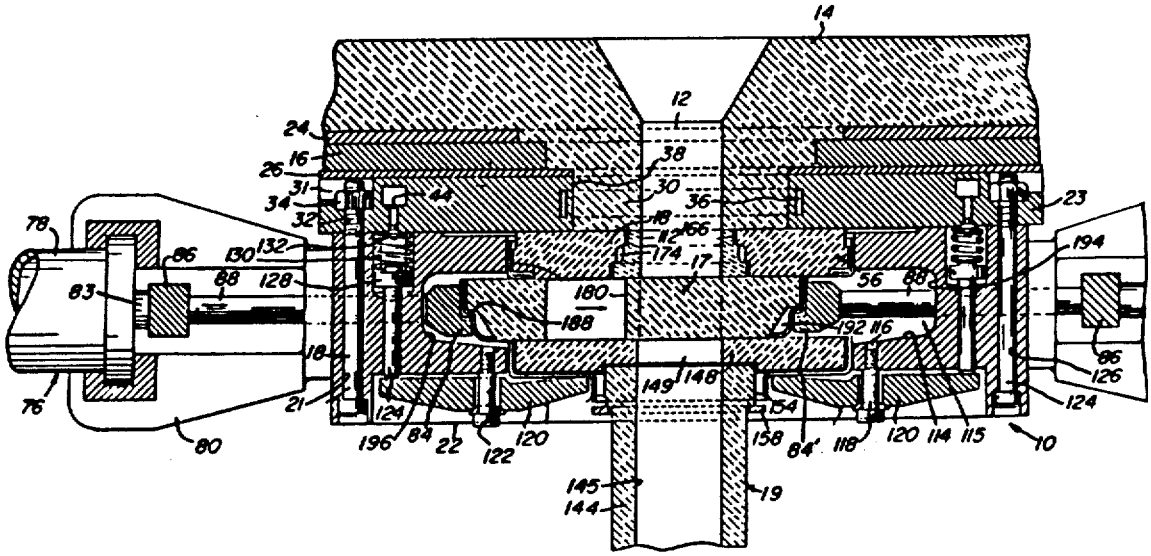

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 5-10 is confirmed.

Claim 1 is determined to be patentable as amended.

Claims 2-4, dependent on an amended claim, are determined to be patentable.

New claims 11-15 are added and determined to be patentable.

1. A gate operative in valve apparatus [of the type] in which apertured gates are conveyed sequentially along a longitudinally extending guide structure into and out of flow controlling relation with the pour opening of a teeming vessel and wherein, in order to adjustably position said gates with respect to said pour opening for flow throttling purposes, said guide structure is movable transversely of the direction of movement of said gates along said guide structure, said gate comprising:

(a) a generally rectangular refractory body having a through opening defining a teeming orifice therein;

(b) means forming shoulders extending parallel to the longitudinal axis of said refractory body for engagement with said guide structure; and (c) said teeming orifice being disposed on a lateral axis of said refractory body in offset relation to said longitudinal axis, the extent of offset being in excess of the radius of said teeming orifice.

*11. A gate operative in valve apparatus in which apertured gates are conveyed sequentially along a longitudinally extending guide structure into and out of flow controlling relation with the pour opening of a teeming vessel and wherein, in order to adjustably position said gates with respect to said pour opening for flow throttling purposes, said guide structure is movable transversely of the direction of movement of said gates along said guide structure, said gate comprising:*

*(a) a generally rectangular refractory body having a through opening defining a teeming orifice therein;*

*(b) means forming shoulders extending parallel to the longitudinal axis of said refractory body for engagement with said guide structure; and*

*(c) said teeming orifice being disposed on a lateral axis of said refractory body in offset relation to said longitudinal axis, the extent of offset of said teeming orifice from said longitudinal axis being equal to about one-half the extent to which the gate is to be moved between its full-open and its full-closed positions.*

*12. A gate according to claim 11 including a metal casing encircling the periphery of said refractory body and said shoulder means for engagement with said guide structure being formed on said casing.*

*13. A gate according to claim 12 in which said casing includes a portion forming a convexly arcuate cam surface subjacent said shoulder means at least along those sides spaced along the longitudinal axis of said body.*

*14. A gate according to claim 13 in which the arcuate cam surface of said casing is disposed in spaced relation from said refractory body; and a cushion of mortar filling the defined space.*

*15. A gate according to either one of claims 4 or 14 in which the surface of said refractory body oppositely spaced from said arcuate cam surface on said metal casing is tapered downwardly and inwardly and cooperates with said casing to define an enlarged space receiving said cushion of mortar.*

* * * * *